United States Patent [19]

Simonin et al.

[11] Patent Number: 4,640,047

[45] Date of Patent: Feb. 3, 1987

[54] TWO-WAY PEDESTRIAN ACCESS CONTROL SYSTEM

[75] Inventors: Marcel Simonin, Bretigny sur Orge; Bernard Garbe, Janville sur Juine; Alain Carron, Saint Germain les Corbeil, all of France

[73] Assignee: Compagnie Generale d'Automatisme CGA-HBS, Paris, France

[21] Appl. No.: 855,256

[22] Filed: Apr. 24, 1986

[30] Foreign Application Priority Data

Apr. 26, 1985 [FR] France ..... 85 06405

[51] Int. Cl.[4] ..... E06B 11/08

[52] U.S. Cl. ..... 49/47

[58] Field of Search ..... 49/47, 46, 70

[56] References Cited

U.S. PATENT DOCUMENTS

| | | | |
|---|---|---|---|
| 3,560,996 | 2/1971 | Berl | 49/47 |
| 3,914,902 | 10/1975 | Lamberson | 49/47 |
| 4,525,951 | 7/1985 | Williams | 49/47 |

*Primary Examiner*—Philip C. Kannan

*Attorney, Agent, or Firm*—Sughrue, Mion, Zinn, Macpeak & Seas

[57] ABSTRACT

Two-way pedestrian access control system comprising a passageway laterally bounded by two pillars, said passageway being normally barred by a barrier locked in close position which can be opened upon validation by a system for recognizing individuals or passes, said barrier comprising a turnstile mounted to one of the pillars and consisting of three arms assembled in conformance with the edges of a regular trihedron and having an axis of rotation confounded with the ternary axis of symmetry of the said turnstile, said axis of rotation being so directed that the turnstile's rotation by $\frac{2}{3}\pi$ about said axis always places an arm in horizontal position, barring the passageway, wherein said barrier further comprises a swinging gate, hinged about a vertical axis lying in the vertical plane containing the said rotational axis of the turnstile, said gate having a cutout enabling passage therethrough of the arms of the turnstile and being high enough to prevent from passing an individual of average size.

1 Claim, 4 Drawing Figures

TWO-WAY PEDESTRIAN ACCESS CONTROL SYSTEM

This invention concerns a two-way pedestrian access control system, for controlling access to premises requiring an entry permit or fee, such as to a subway or railroad platform.

Among the known turnstile-type access control systems, one so-called "space-saver" design allows the turnstile to rotate by one-third of a turn each time an access pass is recognized as valid by an associated passreading system.

An individual can easily by-pass this type of turnstile by going over or under the horizontal arm of the turnstile barring the passageway. The same design on the other hand does provide adequate separation of individuals to satisfactorily avoid another mode of bypass whereby an individual would take advantage of the access clearance accorded a user holding a valid pass by "squeezing" through the open turnstile behind the first. From this latter standpoint then, the common "space-saver" turnstile adequately prevents illegal passage.

In order to prevent the first type of unauthorized passage whilst conserving the inherent user separating advantage of the "space-saver" which prevents the second type of unauthorized passage (the simultaneous passage of two individuals with only one pass), turnstile's have been equipped with a gate beyond the turnstile in the direction of passage.

Indeed, it is much more difficult to bypass a gate, even one that is not very high. Such a barrier need only be high enough to prevent easy straddling straight on or even by pushing off with one's hands from the pillars to either side of the passageway. In practice, the gate needs only be high enough to discourage an easy bypass.

With such a device, the unauthorized passer is stopped by the gate if he is alone and lacks a valid pass, such as a subway ticket for instance and, if he wants to "squeeze through" behind another person, the rotating turnstile provides adequate separation.

However, such a device is operable to prevent both types of bypass only in one direction of passage, that indicated above. In fact, in the case of utilization in the opposite direction, ie. of going first through the gate and then through the turnstile, the system no longer prevents unauthorized passage by two individuals with only one pass because the gate does not ensure adequate separation and once the gate has been passed by two individuals, the second individual faces the same situation as with a simple turnstile, blocked against further rotation following the passage therethrough of the first individual, but nevertheless easily bypassed over or under.

Moreover, such a system does not make it possible to ensure, in terms of pass recognition, a perfect symmetry between the slot for introducing the pass or ticket, or coin, and the axis of rotatation of the turnstile head, and thus between the reading means.

The present invention is directed to obviating these disadvantages whilst preserving the other, advantageous features of "space-saver" type turnstiles, namely their small bulk and low interference with the stream of users.

Accordingly, the invention provides a two-way pedestrian access control system comprising a passageway laterally bounded by two pillars, said passageway being normally barred by a barrier locked in closed position which can be opened upon validation by a system for recognizing individuals or passes, said barrier comprising a turnstile mounted to one of the pillars and consisting of three arms assembled in the pattern of the corners of a regular trihedron and having an axis of rotation confounded with the ternary axis of symmetry of the said turnstile, said axis of rotation being so directed that the turnstile's rotation by $\frac{2}{3}\pi$ about said axis always places an arm in horizontal position, barring the passageway, wherein said barrier further comprises a swinging door, hinged about a vertical axis lieing in the vertical plane containing the said rotational axis of the turnstile, said door or gate having a cutout enabling passage therethrough of the arms of the turnstile and being high enough to prevent from passing an individual of average size.

An embodiment of the invention will now be described with reference to the appended drawings, in which.

Figure 1:
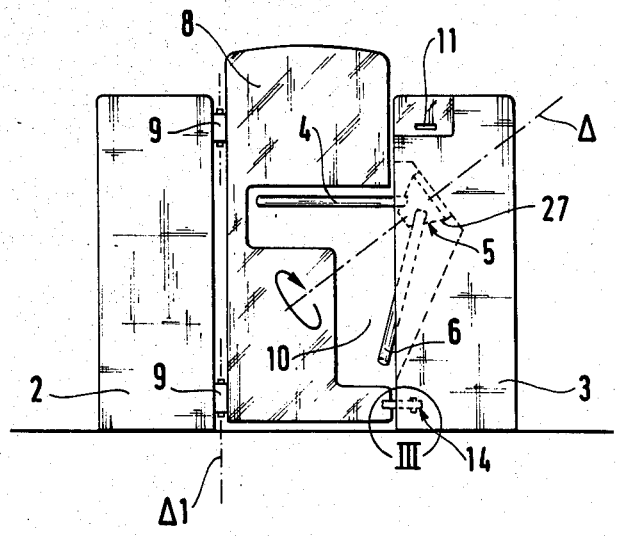
FIG. 1 is a basic elevation of the system according to the invention.
Figure 4:
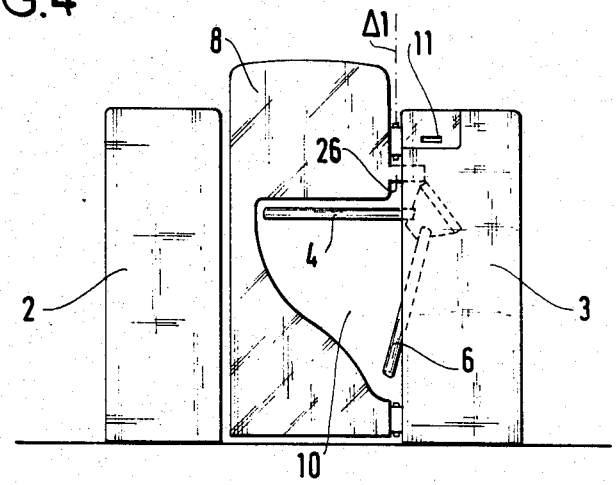

and FIG. 4 is an alternative embodiment of the system of FIG. 1.

Figure 2:
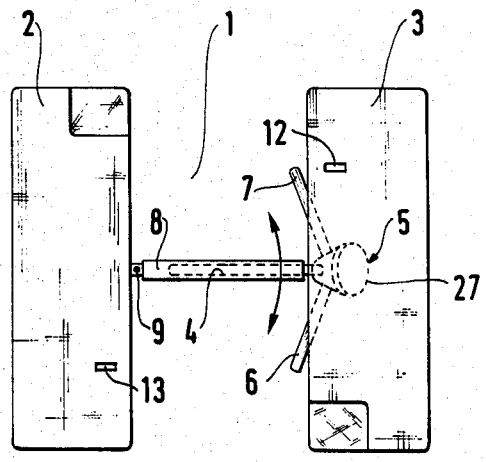
FIG. 2 is a top view of the system illustrated in FIG. 1.

FIGS. 1 and 2 illustrate a two-way pedestrian access control system according to the invention. This comprises a passageway 1 bounded laterally by two pillars 2 and 3.

The passageway 1 is blocked by a double barrier, namely by an arm 4 of a turnstile 5 and by a gate 8.

The arm 4 is part of a turnstile 5 with three arms 4, 6 and 7 assembled by an assembling means or hub 27 and conforming to the edges of a regular trihedron comprising a ternary axis of symmetry $\Delta$ serving as rotational axis for the turnstile. The direction of the rotational axis $\Delta$ is selected so that the arm 4 bars the passageway 1 horizontally and a rotation of the turnstile by $\frac{2}{3}\pi$ substitutes arm 6 for arm 4 and another such rotation substitutes arm 7 for arm 6 and so on. This type of turnstile is in itself well known in the art.

The single-wing gate 8 is articulated on a spring-loaded hinge 9 enabling it to open in both directions. The axis $\Delta_1$ of the hinge 9 is vertical and concurrent with the rotational axis $\Delta$ of the turnstile. The two axes $\Delta$ and $\Delta_1$ therefore define a vertical plane perpendicular to the passageway 1. The gate 8 is given a sufficient height to prevent easy bypassing by an individual of average size. In practice it is advantageously at least as high as the passageway pillars 2 and 3 and perhaps a little higher. It contains a cutout 10 for passage of the turnstile arms.

The pillar 3 further comprises a slot for the indroduction of a ticket or other pass by a user wishing to cross the barrier and a slot 12 for returning said ticket or pass to the user. Since the passageway is for two-way traffic, the pillar 2 likewise contains an insertion slot, not shown in the drawing, and a return slot 13. Inside the pillars 2 and 3 are passreading means quite well known in the art and therefore omitted from the drawing.

Figure 3:
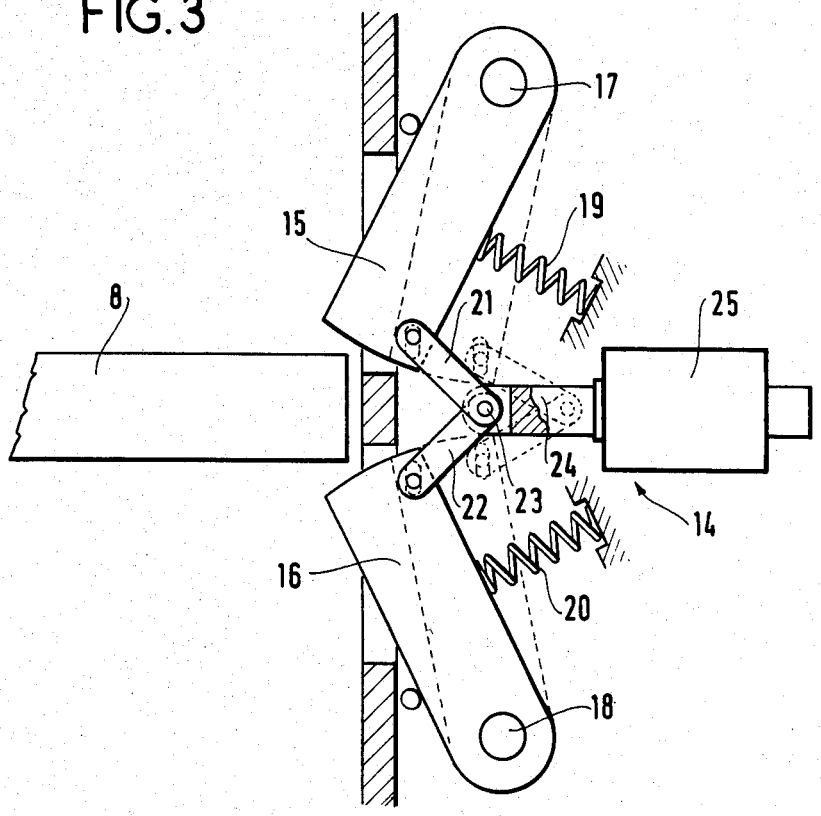
FIG. 3 is a blown up view of the detail identified by numeral III in FIG. 1.

In the absence of a recognized pass, the turnstile cannot be rotated in either direction and the gate 8 is locked in closed position by a keeper system 14 one possible embodiment whereof is represented in FIG. 3.

In the example described, unlocking of the barrier is accomplished by the acknowledgement of a pass inserted into the pillar slot. However, any other releasing system may be envisaged in the context of the invention, such as a person recognition system not requiring introduction of a pass.

The system illustrated in FIG. 3 comprises two cams 15 and 16 pivoting at one end about axes 17 and 18 and urged by springs 19 and 20 into a position preventing gate 8 from opening in both directions. Connecting rods 21 and 22 are articulated at the opposite ends of cams 15 and 16 and are brought together and articulated at 23 on a rod 24 of an electromagnet 25. When a ticket or other pass is introduced into the slot 11 and is acknowledged, the turnstile is released to rotate one-third of a turn and furthermore the electromagnet 25 is powered, bringing about the retraction of cams 15 and 16 to the position represented by broken lines in FIG. 3. The user can pass at this time by pushing the turnstile arm 4 and the gate 8. The ensuing rotation of the turnstile is detected and causes power to be removed from the electromagnet 25. The cams 15 and 16 then return to their initial position under the urging of compression springs 19 and 20. Gate 8 also resumes its initial position under the urging of springs in hinges 9, and stops as the leaf or wing comes to rest against cam 16 having previously resumed its initial locking position (or against cam 15 if the passageway has just been crossed in the opposite direction), said cams retracting, then immediately resuming their starting position under the urging of the springs 19 and 20.

Instead of the latching system just described, two, separately powered electric latches can be used, one on each side of the gate, such that one or the other is powered according to the direction of user passage and thus to the direction of gate opening. Likewise, a more secure latch than the system shown in FIG. 3 can be utilized, which can prevent manual release.

FIG. 4 shows an alternative embodiment of the invention in which the gate 8 hinging $\Delta_1$ is located on the opposite side of the passageway, ie. on the same side as the turnstile mount, on pillar 3.

The cutout 10 for passage of the arms 4, 6 and 7 is in this case somewhat modified and specifically made larger. The latching means can also be located on the same side to bring together all the mechanisms in the same pillar. This configuration merely requires providing a stiff enough tab 26 on the gate to afford the needed leverage. Alternatively, the latching means can be accommodated in pillar 2.

A still further alternative is to motorize the gate, in other words to include a motor to drive door opening pursuant to acknowledgement of a valid pass, such an arrangement, by prompting passage, tending to promote a faster rate of people flow.

Also, a damping system can be incorporated for smoother door closing.

What is claimed is:

1. A two-way pedestrian access control system comprising a passageway laterally bounded by two pillars, said passageway being normally barred by a barrier locked in closed position which can be opened upon validation by a system for recognizing individuals or passes, said barrier comprising a turnstile mounted to one of the pillars and consisting of three arms assembled in conformance with the edges of a regular trihedron and having an axis of rotation confounded with the ternary axis of symmetry of the said turnstile, said axis of rotation being so directed that the turnstile's rotation by $\frac{2}{3}\pi$ about said axis always places an arm in horizontal position, barring the passageway, wherein said barrier further comprises a swinging door, hinged about a vertical axis lieing in the vertical plane containing the said rotational axis of the turnstile, said door or gate having a cutout enabling passage therethrough of the arms of the turnstile and being high enough to prevent from passing an individual of average size.

* * * * *